US006109712A

United States Patent [19]

Haworth et al.

[11] Patent Number: 6,109,712

[45] Date of Patent: Aug. 29, 2000

[54] INTEGRATED VACUUM PANEL INSULATION FOR THERMAL CABINET STRUCTURES

[75] Inventors: George Jeffrey Haworth; Ramamoorthy Srikanth, both of Galesburg, Ill.

[73] Assignee: Maytag Corporation, Newton, Iowa

[21] Appl. No.: 09/116,373

[22] Filed: Jul. 16, 1998

[51] Int. Cl.[7] ..... A47B 96/00

[52] U.S. Cl. ..... 312/400; 312/406

[58] Field of Search ..... 312/401, 400, 312/406; 52/742.11, 742.13, 742.14, 404.3, 404.1, 309.9, 309.12; 220/592.02, 592.1, 62.18, DIG. 9; 62/DIG. 13

[56] References Cited

U.S. PATENT DOCUMENTS

| | | | |
|---|---|---|---|
| 2,768,046 | 10/1956 | Evans . | |
| 2,779,066 | 1/1957 | Gaugler et al. . | |
| 2,863,179 | 12/1958 | Gaugler . | |
| 2,989,156 | 1/1961 | Brooks et al. . | |
| 3,167,159 | 1/1965 | Bovenkerk | 52/404.1 |
| 3,179,549 | 4/1965 | Strong et al. . | |
| 3,264,165 | 8/1966 | Stickel . | |
| 3,440,308 | 4/1969 | Carbary | 220/592.1 X |
| 3,546,846 | 12/1970 | Sens . | |
| 3,910,658 | 10/1975 | Lindenschmidt . | |
| 3,913,996 | 10/1975 | Benford . | |
| 3,933,398 | 1/1976 | Haag . | |
| 3,989,329 | 11/1976 | Benford . | |
| 3,999,820 | 12/1976 | Haag . | |
| 4,000,246 | 12/1976 | Walles . | |
| 4,006,947 | 2/1977 | Haag et al. . | |
| 4,043,624 | 8/1977 | Lindenschmidt . | |
| 4,444,821 | 4/1984 | Young et al. . | |
| 4,529,638 | 7/1985 | Yamamoto et al. . | |
| 4,662,521 | 5/1987 | Moretti . | |
| 4,668,551 | 5/1987 | Kawasaki et al. . | |
| 4,668,555 | 5/1987 | Uekado et al. . | |
| 4,669,632 | 6/1987 | Kawasaki et al. . | |
| 4,681,788 | 7/1987 | Barito et al. . | |
| 4,683,702 | 8/1987 | Vis . | |
| 4,702,963 | 10/1987 | Phillips et al. . | |
| 4,726,974 | 2/1988 | Nowobilski et al. . | |
| 5,018,328 | 5/1991 | Cur et al. . | |
| 5,082,335 | 1/1992 | Cur et al. . | |
| 5,509,248 | 4/1996 | Dellby et al. | 52/742.11 |
| 5,512,345 | 4/1996 | Tsutsumi et al. | 52/404.1 X |
| 5,632,543 | 5/1997 | McGrath et al. | 312/406 |

*Primary Examiner*—Janet M. Wilkens
*Attorney, Agent, or Firm*—Everett G. Diederiks, Jr.

[57] ABSTRACT

A cabinet structure is thermally insulated by placing a first insulation material directly upon a surface of the cabinet structure and then covering the insulation material with a barrier sheet that is affixed along an annular edge portion thereof to the cabinet structure. In this manner, the insulation material is retained within a chamber defined between the barrier sheet and the cabinet structure. This chamber is then evacuated to a low pressure, generally in the order of 0.1–10 mm Hg, and sealed. This integrated vacuum panel insulation arrangement is particularly advantageous for use in constructing entire thermal cabinets by providing a blank that defines multiple walls of the cabinet; arranging the insulation on the inner surfaces of the blank; placing one or more barrier sheets over the insulation; attaching edges of the barrier sheet(s) to the inner surfaces of the walls so as to define respective chambers between the barrier sheet(s) and the respective inner wall surfaces; evacuating each of the chambers; and sealing the chambers. When used with a cabinet that includes an additional liner, this insulation arrangement is preferably used on the shell of the cabinet and, following insertion of the liner within the shell, additional insulation is provided between the liner and the barrier sheet(s).

13 Claims, 4 Drawing Sheets

INTEGRATED VACUUM PANEL INSULATION FOR THERMAL CABINET STRUCTURES

BACKGROUND OF THE INVENTION

1. Field of the Invention

The present invention pertains to the art of thermally insulated cabinet structures and, more particularly, to a cabinet structure including an integrated vacuum panel thermal insulating arrangement.

2. Discussion of the Prior Art

In various fields, it is necessary to insulate structures from a surrounding environment. For instance, in an appliance, such as a refrigerator, freezer, oven/range or dishwasher, an internal compartment of the appliance will be insulated to minimize thermal heat transfer between the compartment and the surrounding environment. The particular type of insulation utilized can actually vary. In refrigerators, for example, it is commonplace to inject a foam insulation into a zone formed between a cabinet shell of the refrigerator and a liner that defines one or more internal food storage compartments. Once the foamed insulation cures, a solid insulation barrier is provided which not only thermally insulates each internal compartment but also adds structural integrity to the overall cabinet assembly.

Another type of thermal insulation that has been found to be advantageous for use in appliances and other cabinet structures is insulation panels. In general, such panels are pre-formed into desired shapes and, in the case of a refrigerator, positioned between inner walls of the cabinet shell and the liner. More specifically, each panel is defined by first and second liner sheets which are sealed together about their edges and between which is arranged a low thermal conductive insulation material, such as fiberglass. To increase their thermal insulation properties, the interiors of such panels can be evacuated prior to insertion of the panels into the cabinet. In any event, the cabinet shell and the vacuum panels are constructed separately and then assembled to form the overall cabinet structure.

Although the use of vacuum panels can enhance the thermal insulation properties of cabinet structures over foam insulation, the cost in materials and labor associated with constructing the cabinet with such panels are rather high. In addition, given that the vacuum panels are pre-formed, numerous voids will be created between the cabinet shell and the liner, each of which will have to be filled with additional insulation material. As these voids can exist between the cabinet shell and the vacuum panels, as well as between the vacuum panels and the liner, rather costly and time consuming lengths must be taken to assure that all of these voids are filled. Otherwise, the thermal insulation characteristics of the cabinet structure will be diminished.

Based on the above, there exists a need in the art for an improved insulation system that reduces costs associated with assembling a vacuum insulated cabinet structure. In addition, there exists a need for a vacuum panel insulation arrangement for cabinet structures which minimizes the number of potential, spaced insulation void areas. Furthermore, there exists a need in the art for a cabinet structure that can be efficiently assembled and which has enhanced thermal insulation properties through the use of a composite insulation arrangement.

SUMMARY OF THE INVENTION

A cabinet structure is thermally insulated through the use of an integrated vacuum panel insulation arrangement. More specifically, a first insulation material is placed upon one side surface of a cabinet member and then a barrier sheet is placed over the first insulation material. An annular edge portion of the barrier sheet is affixed to the surface of the cabinet member such that the first insulation material is arranged within a chamber defined between the cabinet member and the barrier sheet. An access port, which opens up into the chamber, is formed in the barrier sheet and a tube is secured at the access port. A vacuum source is attached to the tube in order to evacuate the chamber and then the tube is sealed. With this arrangement, the surface of the cabinet member and the barrier sheet each define an envelope of the vacuum insulation.

Although this integrated vacuum insulation arrangement can be utilized to thermally insulate various cabinet members, it is particularly adapted for use in insulating appliance cabinets, such as a refrigerator cabinet. In accordance with the preferred embodiment of the invention, a refrigerator cabinet is thermally insulated by forming a cabinet blank that defines multiple walls of a cabinet shell and arranging the first insulation material on each of these walls. Thereafter, a barrier sheet is placed over the insulation material on each of the walls and the edges of each of the barrier sheets are secured to a respective inner wall surface in order to establish multiple insulated chambers. Access ports are then provided which lead into each of the chambers and tubes are secured at the ports. At this point, the cabinet blank can be bent to erect the cabinet shell and define integrally formed side and top walls thereof. A rear wall blank member can then be attached to complete the outer shell. Once this attachment is complete, each of the tubes are connected to a vacuum system and the chambers are evacuated to low pressures, generally in the order of 0.1–10 mm Hg. The tubes are sealed at the end of the evacuation process through a crimping, brazing, ultrasonic welding or the like process. Once the evacuation has occurred and the tubes are sealed, a plastic food liner is inserted into the cabinet. Finally, a second insulation material, preferably polyurethane foam, is injected between the barrier sheets and the liner to provide additional insulation and to add overall structural integrity to the cabinet.

From the above, it should be readily apparent that a highly insulated cabinet structure can be assembled at a reduced cost since the invention provides for an integrated assembly process for producing vacuum panel insulated cabinet structures. Furthermore, this proposed thermal insulation system reduces material costs since a side of each of the cabinet structures constitutes one of the envelopes of the vacuum insulation. Additional features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
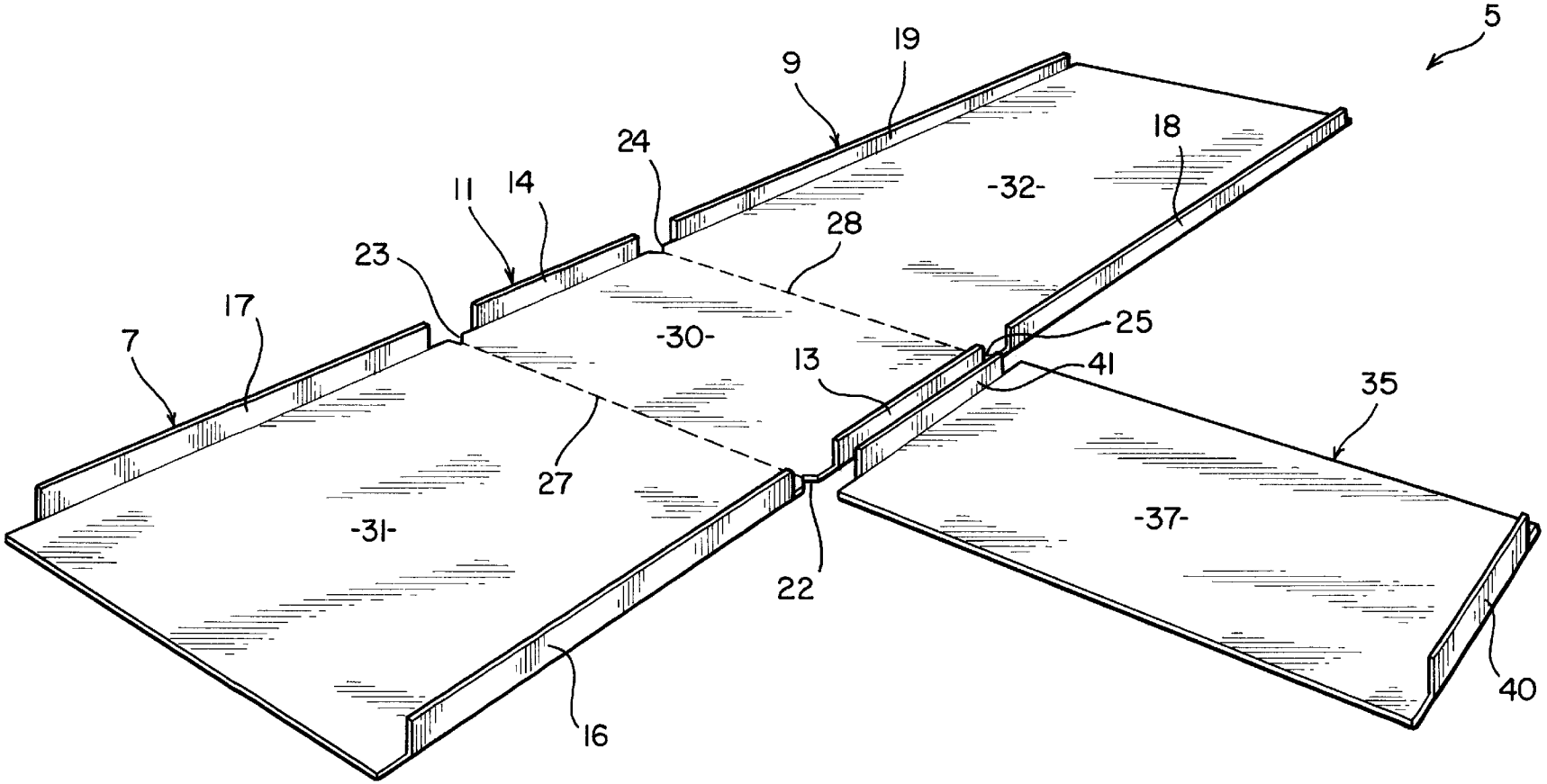
FIG. 1 is a perspective view of a notched cabinet blank formed during an initial cabinet assembly process in accordance with the present invention.

Although the integrated vacuum panel insulation arrangement of the present invention can be utilized to thermally insulate various cabinet structures, the invention will be described with respect to a preferred embodiment thereof wherein a refrigerator cabinet is insulated in accordance with the present invention. Therefore, with initial reference to FIG. 1, a blank, that will be used to construct a refrigerator cabinet shell, is generally indicated at 5. Blank 5 includes a first side section 7, a second side section 9 and a central section 11 which interconnects first and second side sections 7 and 9. As will become more fully apparent below, first and second side sections 7 and 9 will define opposing walls of a cabinet shell and central section 11 will define a top shell wall. In the preferred embodiment, blank 5 is formed of sheet metal.

As clearly shown in this figure, central section 11 is provided with a pair of spaced, up-turned flange portions 13 and 14. In a similar manner, first and second side sections 7 and 9 are also provided with respective up-turned flange portions 16–19. At the junctions between central section 11 and each of first and second side sections 7 and 9, respective notches 22–25 are formed. In this figure, notches 22 and 23 are shown to be arranged along a fold line 27 and notches 24 and 25 are shown to be aligned along a fold line 28. As will be discussed more fully below, blank 5 is intended to be bent along fold lines 27 and 28 when the cabinet shell is erected. However, at this point, it should merely be additionally noted that central section 11 has a first or inner surface 30 and that first and second side sections define first or inner side surfaces 31 and 32 respectively. Blank 5 also defines a rear wall member 35 which defines a first or inner surface 37. At longitudinal ends of rear wall member 35, a pair of up-turned flange portions 40 and 41 are formed.

Figure 2:
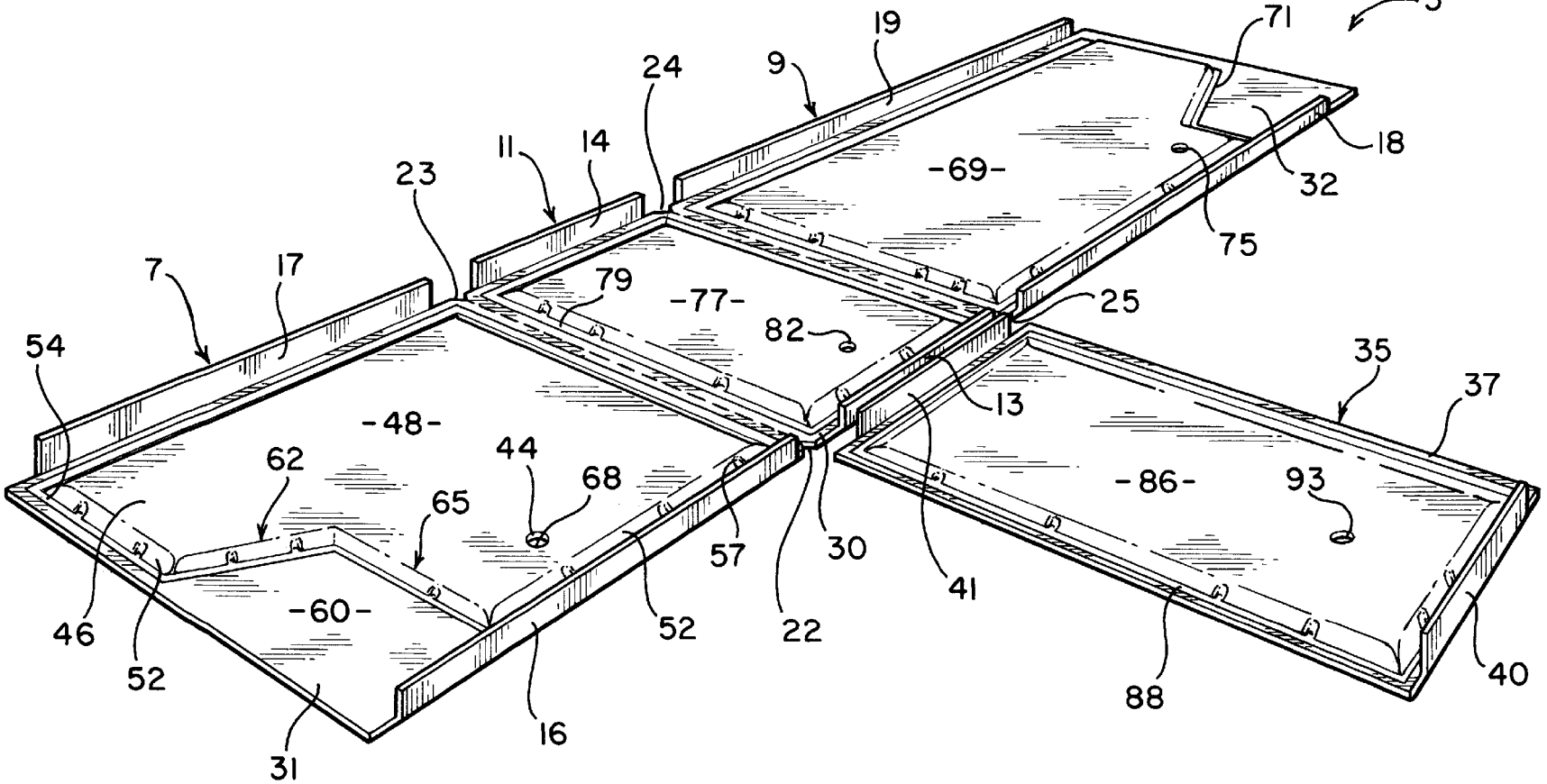
FIG. 2 illustrates the cabinet blank of FIG. 1 with a first, covered insulation material applied thereto.

From the above description, it should be realized that arranging blank 5 in the manner set forth above constitutes an initial stage in the assembly process for a thermally insulated refrigerator cabinet in accordance with the present invention. During a second stage as represented in FIG. 2, a first insulation material 44 is arranged atop each of first surfaces 30, 31, 32 and 37. In accordance with the present invention, first insulation material 44 preferably comprises a low thermal conductive ceramic, such as fiberglass. As will be further illustrated and discussed with reference to FIG. 5 herein, first insulation material 44 can take various forms, including loose fiberglass, a ceramic powder or an insulating board. As the manner in which first and second side sections 7 and 9, central section 11 and rear wall member 35 are insulated in accordance with the present invention is the same, a detailed description of the manner in which first side section 7 is insulated will now be made and it should be understood that the other portions of blank 5 are insulated in the corresponding manner.

Placed atop first insulation material 44 on first side section 7 is a barrier sheet 46. In accordance with the preferred embodiment, barrier sheet 46 constitutes a metallic foil that can be formed from either a ferrous or non-ferrous material. Of course, although a metallic material is preferred, barrier sheet 46 can also be formed from non-metallic materials without departing from the spirit of the invention. When placed upon first insulation material 44, barrier sheet 46 defines an upper surface 48, various sloped sections 52 and numerous edge portions 54. Edge portions 54 are preferably arranged directly upon first surface 31 of first side section 7 and extend annularly about first insulation material 44. Since barrier sheet 46 is preferably formed from a metallic material, various crimped zones 57 will be inherently formed along slope sections 52. As illustrated in this figure, first insulation material 44 and barrier sheet 46 do not extend over the entire surface 31 of first side section 7. Instead, side surface 31 has an exposed zone 60 upon which insulation material 44 is not placed. This is also true of the arrangement of first insulation material 44 on second side section 9. Zone 60 is preferably left exposed given that blank 5 is specifically designed to construct a refrigerator cabinet and this area is generally dedicated to the mounting of a compressor, condenser and fan assembly. In any event, the presence of zone 60 merely illustrates that insulating a cabinet structure in accordance with the present invention can be readily tailored to accommodate specific design configurations. In the present example, first insulation material 44 and barrier sheet 46 need merely be arranged to define a slanted section 62 and a straight section 65 in order to define exposed zone 60.

Once first insulation material 44 and barrier sheet 46 are properly positioned, annular edge portions 54 are then affixed to surface 31 of first side section 7. More specifically, barrier sheet 46 is sealed to first side section 7 such that a chamber 67 (labeled in FIG. 5 only), within which first insulation material 44 is contained, is defined between first side section 7 and barrier sheet 46. Since barrier sheet 46 constitutes a metallic foil in the preferred embodiment of the invention, it is preferable to seam weld barrier sheet 46 to surface 31 of first side section 7.

As shown in FIG. 2, barrier sheet 46 is formed with an access port 68 that opens into chamber 67. Access port 68 can be either pre-formed within barrier sheet 46 or it can be made after barrier sheet 46 is arranged on first side section 7. As indicated above, second side section 9, central section 11 and rear wall member 35 are similarly modified. More specifically, first insulation material 44 is placed atop each of second side section 9, central section 11 and rear wall member 35. A barrier sheet 69 would then be placed upon the first insulation material 44 on second side section 9 and an annular edge portion 71 of barrier sheet 69 would be affixed to first side surface 32 of second side section 9. Also a corresponding access port 75 would be provided. Likewise, central section 11 would be provided with a barrier sheet 77 that has an annular edge portion 79 sealed to surface 30 and an access port 82. Finally, a barrier sheet 86 would be used to cover the first insulation material 44 placed upon rear wall member 35 and an edge portion 88 of barrier sheet 86 would be secured to inner surface 37 of rear wall member 35. An access port 93 would also be provided which opens up into the chamber (not separately labeled) formed between barrier sheet 86 and surface 37 of rear wall member 35.

Figure 3:
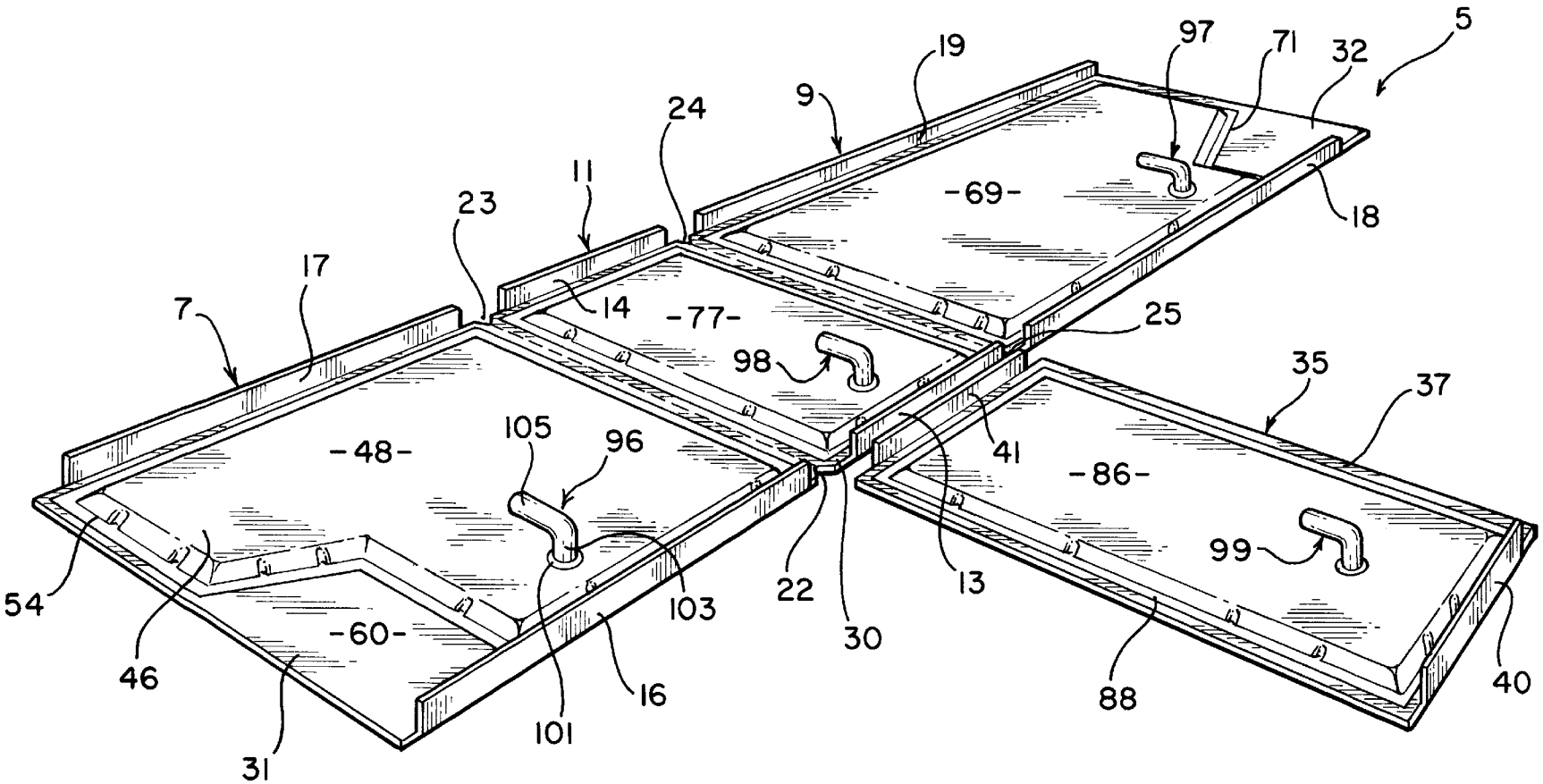
FIG. 3 illustrates a further step in the insulation phase of the cabinet assembly process in accordance with the present invention.

The next stage in the assembly process is shown in FIG. 3 wherein evacuation tubes 96–99 are affixed at access ports 68, 75, 82 and 93 respectively. In accordance with the preferred embodiment, each evacuation tube 96–99 includes a straight section 103 and an angled section 105. Evacuation tubes 96–99 are also preferably formed of metal and are brazed at 101 to a respective access port 68, 75, 82 and 93 such that they open up into a corresponding chamber 67.

Figure 4:
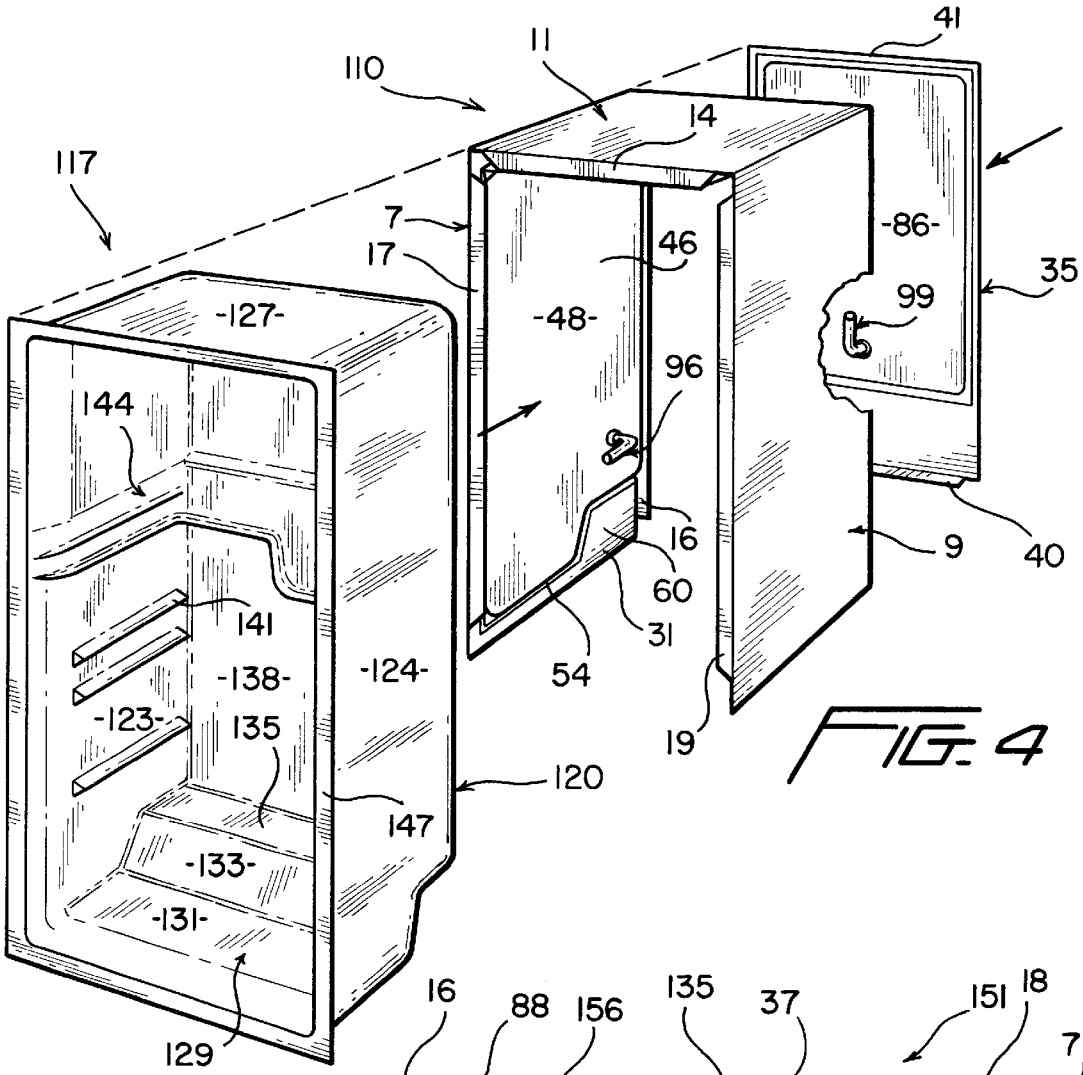
FIG. 4 is an exploded view of a cabinet structure constructed in accordance with the present invention.

After evacuation tubes 96–99 are attached, blank 5 is bent in order to form side and top portions of a refrigerator cabinet shell that is generally indicated at 110 in FIG. 4.

Thereafter, rear wall member 35 is attached to the remainder of shell 110, preferably by welding or crimping rear wall member 35 to up-turned flange portions 13, 16 and 18. Once shell 110 is assembled, evacuation tubes 96–99 are connected to a vacuum system (not shown) and the first insulation material 44 provided within each chamber 67 is subjected to an evacuation pressure, generally in the order of 0.1–10 mmHg. Thereafter, evacuation tubes 96–99 are sealed by crimping, brazing, ultrasonic welding or the like. Following this completion phase of the integrated vacuum panel insulation, a liner unit 117 is inserted within shell 110. As shown, liner unit 117 comprises an integral plastic body 120 having side walls 123 and 124, a top wall 127, a bottom wall 129 which is defined by a first, generally horizontal section 131, an upwardly sloping section 133 and a second, generally horizontal section 135 that leads to a rear wall 138. As is known in the art, liner unit 117 can be integrally formed with various molded rails 141, as well as a mullion area 144, for use in dividing the interior of liner unit 117 into various compartments or storage zones for food items. As illustrated, liner unit 117 also includes a front edge that defines an out-turned flange 147. When inserted within shell 110, out-turned flange 147 abuts up-turned flange portions 14, 17 and 19 and can be adhesively secured thereto. At this point, it should be noted that FIG. 4 illustrates that the insulation material 44 and barrier sheet 86 need not traverse rear wall member 35 to the extent shown in FIGS. 2 and 3 but may terminate at a position spaced farther from in-turned flange portion 40 than that shown in FIGS. 2 and 3 without departing from the spirit of the invention. In other words, first insulation material 44 can be conserved by increasing the percentage of rear wall member 35 that is not insulated to a height generally commensurate with that of exposed zone 60 as shown in FIG. 4.

Figure 5:
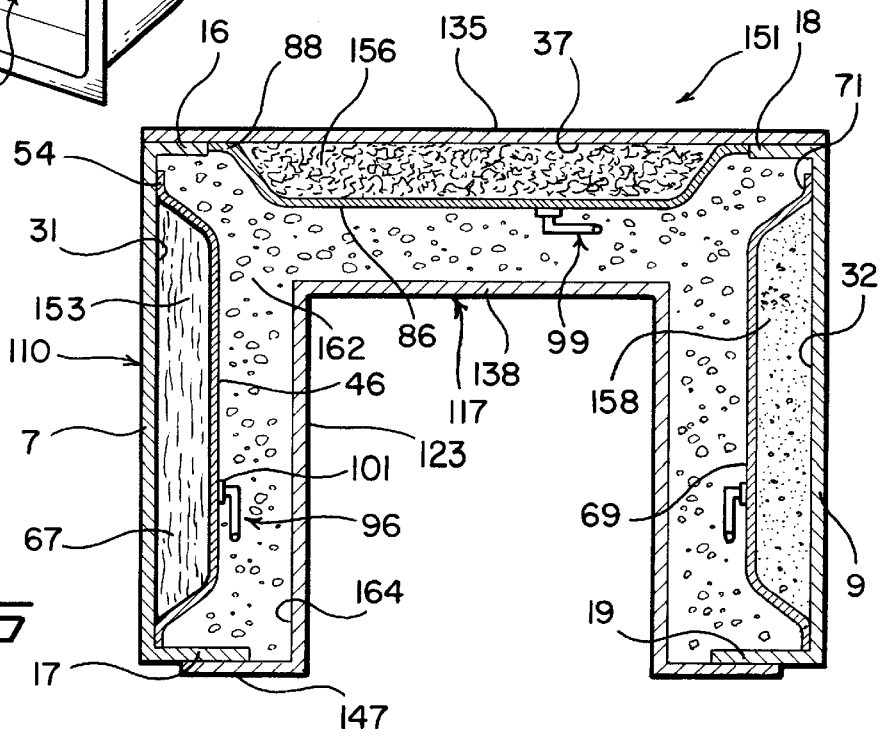
FIG. 5 is a cross-sectional view of the cabinet structure constructed in accordance with the present invention.

FIG. 5 depicts a cross-sectional view of the refrigerator cabinet 151 constructed in accordance with the preferred embodiment of the present invention. First of all, it should be noted that FIG. 5 separately illustrates three versions for insulation material 44 by showing it in board form at 153, as loose fiberglass at 156 and in powder form at 158. Once cabinet 151 is assembled to the point discussed above with reference to FIG. 4, a second insulation material 162, preferably polyurethane foam, is injected between each barrier sheet 46, 69, 77 and 86 and an outer wall 164 of liner unit 117 such that a composite insulation arrangement is formed. Once second insulation material 162 cures, it will not only provide additional insulation for the cabinet structure, but it will add structural integrity thereto.

From the above description, it should be readily apparent that the present invention provides for a composite insulation arrangement for cabinet structures and includes an integrated vacuum panel insulation system. This construction and assembly method will reduce costs associated with constructing a vacuum insulated cabinet structure and achieves significant advantages since it avoids the use of pre-formed vacuum panels. As a side of each of the cabinet structures constitutes one of the envelopes of the vacuum insulation, the present invention reduces material costs as well and also eliminates the potential for the development for insulation void areas. In other words, since each of the insulation chambers 67 is defined, at least in part, by the cabinet structure itself, the only insulation void area presented is between the barrier sheets 46, 69, 77 and 86, and this area is filled with the second insulation material 162. If pre-formed insulation panels were utilized, it is possible that additional void areas would be formed between the panels and the shell 110 and these void areas may not be filled when the second insulation material 162 is injected. Therefore, this potential problem is avoided in accordance with the present invention.

Although described with respect to a preferred embodiment of the invention, it should be readily understood that various changes and/or modifications can be made to the invention without departing from the spirit thereof. For instance, it should be readily apparent that various cabinet structures can be insulated in the manner set forth above. For example, a door for refrigerator cabinet 151 could also be insulated in a corresponding manner. In addition, although the preferred embodiment of the invention utilizes multiple barrier sheets on a single blank, it is possible to utilize a single barrier sheet and to simply seal the barrier sheet to each section of the blank at spaced locations. In general, the invention is only intended to be limited by the scope of the following claims.

We claim:

1. A thermal insulated cabinet structure comprising:

a cabinet member, defining one of a plurality of walls of the structure, having first and second opposed surfaces;

a first insulation material positioned on the first surface of said cabinet member;

a barrier sheet extending over the first insulation material on said cabinet member, said barrier sheet including edge portions affixed to the first surface of said cabinet member such that a chamber, within which the first insulation material is contained, is defined between said cabinet member and said barrier sheet; and an access port opening into said chamber for use in evacuating the chamber with the first surface of said cabinet member and said barrier sheet defining envelopes of a vacuum insulation.

2. The thermal insulated cabinet structure according to claim 1, wherein said barrier sheet is formed from a metallic material.

3. The thermal insulated cabinet structure according to claim 2, wherein said barrier sheet comprises a foil formed from a ferrous material.

4. The thermal insulated cabinet structure according to claim 2, wherein said barrier sheet comprises a foil formed from a non-ferrous material.

5. The thermal insulated cabinet structure according to claim 1, wherein said first insulation material comprises a low thermal conductive ceramic.

6. The thermal insulated cabinet structure according to claim 5, wherein said first insulation material comprises an insulating board.

7. The thermal insulated cabinet structure according to claim 1, further comprising an evacuation tube attached to said access port.

8. The thermal insulated cabinet structure according to claim 1, wherein said cabinet member defines a wall of a cabinet shell, said cabinet structure further comprising:

a plurality of additional, cabinet shell defining walls;

a liner unit positioned within the walls of said cabinet shell, said liner unit having inner and outer wall surfaces with said inner wall surface defining at least one interior compartment; and a second insulation material provided between said barrier sheet and the outer wall surface of said liner unit.

9. The thermal insulated cabinet structure according to claim 8, wherein said second insulation material comprises polyurethane foam.

10. The thermal insulated cabinet structure according to claim 9, wherein a plurality of said walls are defined by a single metal blank that is adapted to be bent at predetermined locations to define said cabinet shell prior to evacuation of said chamber.

11. The thermal insulated cabinet structure according to claim 9, wherein said first insulation material comprises a low thermal conductive ceramic.

12. The thermal insulated cabinet structure according to claim 8, wherein said cabinet shell is made of metal and said liner unit is formed from plastic.

13. The thermal insulated cabinet structure according to claim 12, wherein said barrier sheet is formed from a metallic foil.

* * * * *